United States Patent [19]

Frei et al.

[11] Patent Number: 4,512,490

[45] Date of Patent: Apr. 23, 1985

[54] STRENGTHENED CAN BODIES OF THIN-WALLED METAL

[75] Inventors: Siegfried Frei, St. Gallen; Jakob Koch, Hünibach, both of Switzerland

[73] Assignees: Cantec, Inc., Forth Worth, Tex.; Gebrueder Hoffmann AG, Thun, Switzerland; a part interest

[21] Appl. No.: 374,146

[22] Filed: May 3, 1982

[30] Foreign Application Priority Data

May 12, 1981 [DE] Fed. Rep. of Germany ..... 3118781

[51] Int. Cl.[3] ..... B65D 8/08; B65D 8/12

[52] U.S. Cl. ..... 220/72; 220/1 BC

[58] Field of Search ..... 220/72, 1 BC

[56] References Cited

U.S. PATENT DOCUMENTS

| | | | |
|---|---|---|---|
| 397,163 | 2/1889 | Zinsser, Jr. | 220/72 X |
| 1,240,029 | 9/1917 | Darley, Jr. | 220/72 X |
| 1,246,947 | 11/1917 | Schott | 220/72 X |
| 2,063,013 | 12/1936 | Cooper | 220/72 |
| 2,438,844 | 3/1948 | Dale | 220/72 X |
| 2,441,476 | 5/1948 | Ewald . | |
| 3,166,829 | 1/1965 | Lemelson | 220/72 X |
| 3,335,902 | 8/1967 | Javorik | 220/72 |
| 3,357,593 | 12/1967 | Sears et al. . | |
| 3,438,507 | 4/1969 | Krenser | 220/72 X |
| 3,472,418 | 10/1969 | Ullman . | |
| 3,648,884 | 3/1972 | Mansolino . | |
| 4,315,574 | 2/1982 | Forny et al. | 220/72 |

FOREIGN PATENT DOCUMENTS

| | | | |
|---|---|---|---|
| 1452591 | 3/1969 | Fed. Rep. of Germany | 220/72 |
| 1586928 | 10/1970 | Fed. Rep. of Germany . | |
| 3001787 | 8/1980 | Fed. Rep. of Germany . | |
| 736321 | 11/1932 | France | 220/72 |
| 58857 | 4/1954 | France | 220/72 |
| 7221013 | 1/1974 | France . | |
| 172514 | 10/1934 | Switzerland | 220/72 |
| 521889 | 4/1972 | Switzerland . | |
| 264732 | 1/1927 | United Kingdom . | |
| 754549 | 8/1956 | United Kingdom . | |
| 972165 | 10/1964 | United Kingdom . | |
| 1038897 | 8/1966 | United Kingdom . | |
| 1375070 | 11/1974 | United Kingdom . | |
| 1586484 | 3/1981 | United Kingdom . | |

*Primary Examiner*—Allan N. Shoap

*Attorney, Agent, or Firm*—Werner W. Kleeman

[57] ABSTRACT

A can formed of a thin-walled material, especially sheet metal or metal plate, whose can body is provided with beads extending essentially in axial direction and circumferential direction for the purpose of increasing the strength of the can bodies. In particular, these are provided primary beads extending in a first direction, and protuberances or raised portions forming auxiliary beads extending essentially perpendicular to the primary beads flow into or continuously merge with the primary beads.

7 Claims, 38 Drawing Figures

Fig. 6
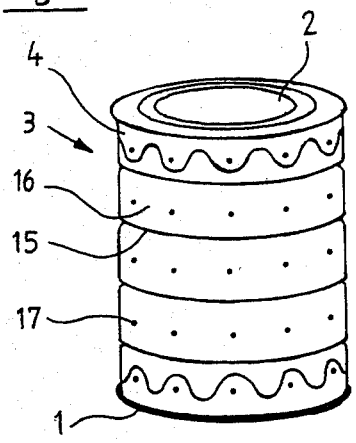
Fig. 6a
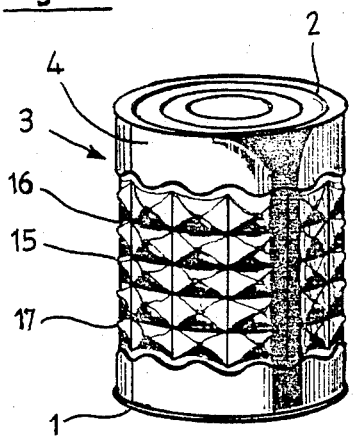
Fig. 7
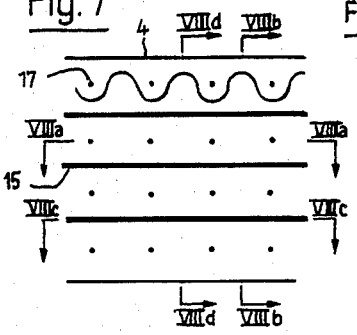
Fig.8b Fig.8d
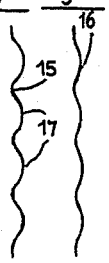
Fig.8a
Fig.8c
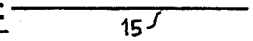
Fig. 9
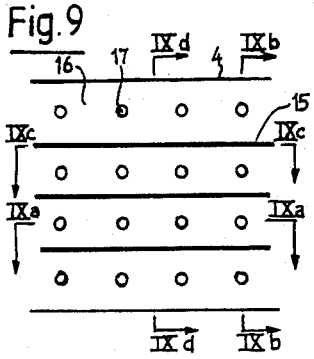
Fig.9b Fig.9d
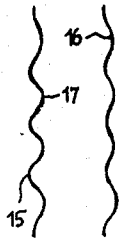
Fig.9a
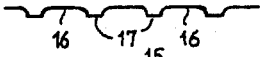
Fig.9c
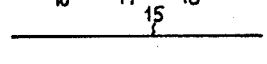
Fig. 10
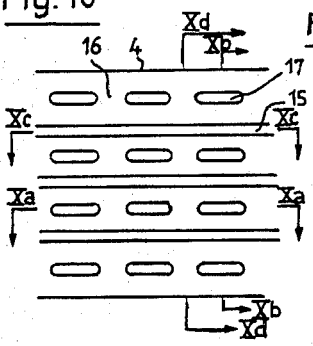
Fig.10b Fig.10d
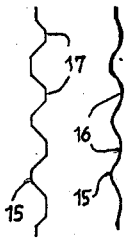
Fig.10a
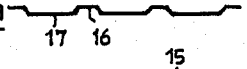
Fig.10c
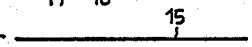
Fig. 11
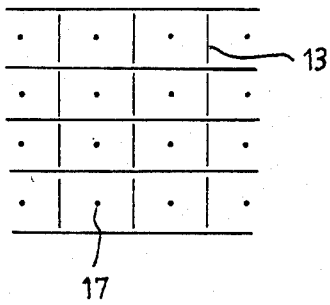

STRENGTHENED CAN BODIES OF THIN-WALLED METAL

CROSS-REFERENCE TO RELATED APPLICATION

This application is related to the U.S. application Ser. No. 06/374,147, filed May 3, 1982, entitled "Method and Apparatus for Beading the Bodies of Sheet Metal Cans".

BACKGROUND OF THE INVENTION

The present invention relates to new and improved constructions of cans formed of a thin-walled material and a method for the fabrication thereof.

Generally speaking, the cans of the present development which are formed of a thin-walled material, especially metal plate or sheet metal, have the can bodies thereof provided with beads extending essentially in the axial and circumferential directions for the purpose of increasing the strength of the can bodies.

There are already known in this technology different constructions of cans which, for the purpose of increasing the strength of the can bodies, are provided with so-called beads extending in radial direction as well as in axial direction.

For instance, in U.S. Pat. No. 3,335,902, granted Aug. 15, 1967, there has been disclosed in this technology a bead arrangement wherein circumferential and axially arranged beads intersect one another and the depth of the beads at the intersection locations amount to the algebraic sum of the bead depth of the axial and circumferential beads.

In U.S. patent application Ser. No. 115,891, filed Jan. 28, 1980, there is disclosed an arrangement for large containers wherein there are provided uninterrupted axial and circumferential bead groups. The individual circumferential or peripheral beads predominantly consist of circular beads and the axial beads consist of bead groups arranged offset with respect to one another.

In German Petty Pat. No. 8,024,406 there is disclosed a packaging container wherein there are provided circumferentially or peripherally extending bead sections or portions distributed over the circumference of the container body, and whose mutual circumferential spacing is less than their length. At the region between the beads, i.e. at the spacings, the container body is free of beads or rib-shaped beading.

Another construction of sheet metal container containing beading is disclosed in British Pat. No. 978,982, published Jan. 1, 1965.

The prior art bead or beading constructions already contribute to an appreciable increase in the strength of the can or container body. In the case of small containers, such as food cans or lacquer cans, the state-of-the-art proposals do not however afford the strived for reinforcement of the container or can body. In particular, mass or series production of the prior art containers or cans is technically complicated.

SUMMARY OF THE INVENTION

Therefore, with the foregoing in mind it is a primary object of the present invention to provide new and improved constructions of cans or the like formed of thin-walled material and a method of fabricating the same, wherein there is afforded an improved strengthening or reinforcement of the can bodies.

Another and more specific object of the present invention aims at a new and improved construction of a can whose can body strength, notwithstanding a reduced wall thickness, is greater in axial and radial directions than or at least equal to the strength of the heretofore known cans or container bodies.

A further significant object of the present invention aims at configuring the body of cans or containers or the like such that they can be fabricated more economically and in a production line along with the production of the can body, such as during the welding, soldering, deep-drawing or stretching operations.

Still a further important object of the present invention is to maintain the material deformation of the cans as small as possible.

A further object aims at accomplishing the material deformation, typically the embossment, also without the need to resort to congruent counter tools for the embossment tools.

Now in order to implement these and still further objects of the invention, which will become more readily apparent as the description proceeds, the can construction of the present development is manifested by the features that there are provided primary beads extending in a first direction. The protuberances or raised portions forming auxiliary beads and extending essentially at right angles or perpendicular to the primary beads flow into or continuously merge with the primary beads.

As alluded to above, the invention is not only concerned with the aforementioned novel can constructions but to methods of fabricating cans of the aforementioned type, wherein the embossing of the beads and/or protuberances can be accomplished without the use of a congruent counter tool.

A characterising aspect of the present invention is the dominance of the primary beads, the effect of which is not impaired by the auxiliary beads and/or the protuberances or raised portions forming the auxiliary beads.

What is surprising as concerns the teachings of the invention is that, in contrast to conventional circumferential or peripheral bead constructions, in this case it is not the protuberances which form the predominantly effective beads, rather the valleys or crests remaining between two protuberances.

What is further surprising with the inventive constructions of cans is the slight degree of the beading of the container or can bodies in accordance with the beading configurations or images according to the invention which is needed for the realisation of the requisite strengthening or reinforcement of the can bodies. The height of the protuberances or raised portions of the axial beads amounts to, for instance, in the case of a can of 1 liter content, only about 1 millimeter, that of the circumferential beads to about 30% to 90% of the height of the axial beads.

Beading defects, such as fissures in the can body material, therefore need not be feared.

Advantageous for the formation of the circumferential beads is the use of protuberances containing a sector of spherical-shaped, truncated pyramid-shaped or truncated cone-shaped surfaces. Such type of protuberances or raised portions can be additionally easily technically fabricated, in particular also without the use of congruent counter tools.

It has been surprisingly found that the can constructions of the invention not only eliminate the drawbacks of the conventional bead arrangements or beading, but furthermore, there is afforded the possibility of using thinner and harder, and thus, less expensive metal plate or sheet metal for the same and usually, in fact, increased strength or rigidity of the metal cans or containers.

This saving-in-weight in metal plate or sheet metal, by virtue of the beading, amounts to at least 25% in relation to the heretofore known cans provided with circular beads.

Due to the protective treatment or handling during the beading operation or work the position of the axial seam, the so-called thickened portion of the can—to the extent that such is soldered or welded from a can blank—is without influence upon the beading configuration or image.

A further advantage resides in the fact that, depending upon the direction, the embossment configuration or image renders possible an appreciable increase in strength of the container or can body either in axial or in radial direction in accordance with the momentary requirements as concerns increased loadability, without the strength of the can body in the other direction dropping below the heretofore required values.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2*a* is a cross-sectional view of the can depicted in FIG. 2, taken substantially along the line IIa—IIa thereof;

FIG. 2*b* is a cross-sectional view of the can shown in FIG. 2, taken substantially along the line IIb—IIb thereof;

FIG. 2*c* is a cross-sectional view of the can shown in FIG. 2, taken substantially along the line IIc—IIc thereof;

FIG. 2*d* is a cross-sectional view of the can shown in FIG. 2, taken substantially along the line IId—IId thereof;

FIG. 3*a* is a cross-sectional view of the can depicted in FIG. 3, taken substantially along the line IIIa—IIIa thereof;

FIG. 3*b* is a cross-sectional view of the can shown in FIG. 3, taken substantially along the line IIIb—IIIb thereof;

FIG. 3*c* is a cross-sectional view of the can shown in FIG. 3, taken substantially along the line IIIc—IIIc thereof;

FIG. 3*d* is a cross-sectional view of the can shown in FIG. 3, taken substantially along the line IIId—IIId thereof;

FIG. 4*a* is a cross-sectional view of the can depicted in FIG. 4, taken substantially along the line IVa—IVa thereof;

FIG. 4*b* is a cross-sectional view of the can depicted in FIG. 4, taken substantially along the line IVb—IVb thereof;

FIG. 4*c* is a cross-sectional view of the can depicted in FIG. 4, taken substantially along the line IVc—IVc thereof;

FIG. 4*d* is a cross-sectional view of the can depicted in FIG. 4, taken substantially along the line IVd—IVd thereof;

FIG. 6 is a schematic view of a further preferred construction of can according to the invention;

FIG. 6*a* is a perspective view of the can construction shown in FIG. 6;

FIG. 7 is a development view of the can body of the can depicted in FIG. 6 and shown in a single plane;

FIG. 8*a* is a cross-sectional view of the can depicted in FIG. 7, taken substantially along the line VIIIa—VIIIa;

FIG. 8*b* is a cross-sectional view of the can depicted in FIG. 7, taken substantially along the line VIIIb—VIIIb;

FIG. 8*c* is a cross-sectional view of the can depicted in FIG. 7, taken substantially along the line VIIIc—VIIIc thereof;

FIG. 8*d* is a cross-sectional view of the can depicted in FIG. 7, taken substantially along the line VIIId—VIIId thereof;

FIG. 9 is a development view of the can or container body of a further embodiment of can analogous to the view of FIG. 7;

FIG. 9*a* is a cross-sectional view of the can depicted in FIG. 9, taken substantially along the line IXa—IXa thereof;

FIG. 9*b* is a cross-sectional view of the can depicted in FIG. 9, taken substantially along the line IXb—IXb thereof;

FIG. 9*c* is a cross-sectional view of the can depicted in FIG. 9, taken substantially along the line IXc—IXc thereof;

FIG. 9*d* is a cross-sectional view of the can depicted in FIG. 9, taken substantially along the line IXd—IXd thereof;

FIG. 10 is a development view of the can body of a further construction of can analogous to the showing of FIG. 7;

FIG. 10*a* is a cross-sectional view of the can depicted in FIG. 10, taken substantially along the line Xa—Xa thereof;

FIG. 10*b* is a cross-sectional view of the can depicted in FIG. 10, taken substantially along the line Xb—Xb thereof;

FIG. 10*c* is a cross-sectional view of the can depicted in FIG. 10, taken substantially along the line Xc—Xc thereof;

FIG. 10*d* is a cross-sectional view of the can depicted in FIG. 10, taken substantially along the line Xd—Xd thereof;

FIG. 11 is a front view of a can body shown in a development view in a plane analogous to the showing of FIG. 7 and depicting a further embodiment of inventive can;

DETAILED DESCRIPTION OF THE PREFERRED EMBODIMENTS

Figure 1:
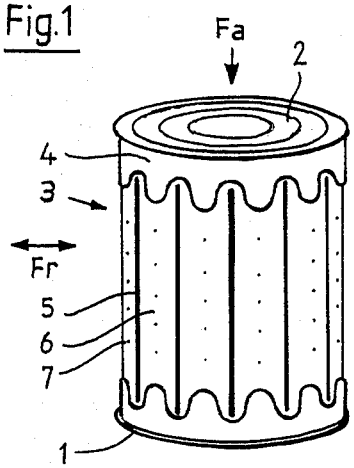
FIG. 1 is a schematic view of a preferred embodiment of a can constructed according to the invention.
Figure 1A:
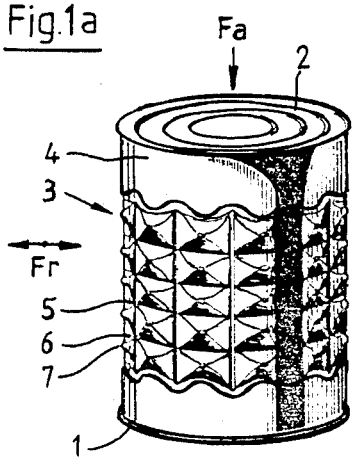
FIG. 1*a* is a perspective view of the can shown in FIG. 1.
Figure 2:
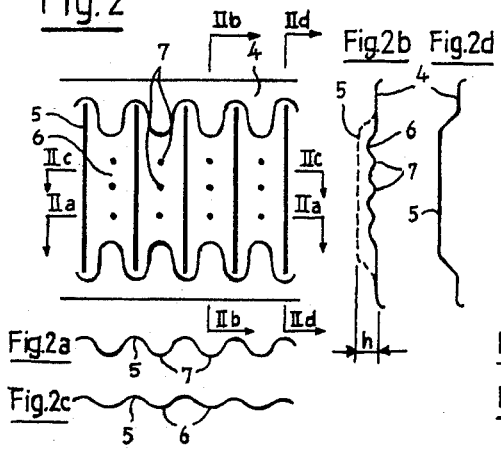
FIG. 2 is a development view of the can body of the can illustrated in FIG. 1 and shown located in a single plane, wherein the illustration of FIG. 2 corresponds to the illustration of the can shown in FIG. 1 viewed from externally thereof.
Figure 3:
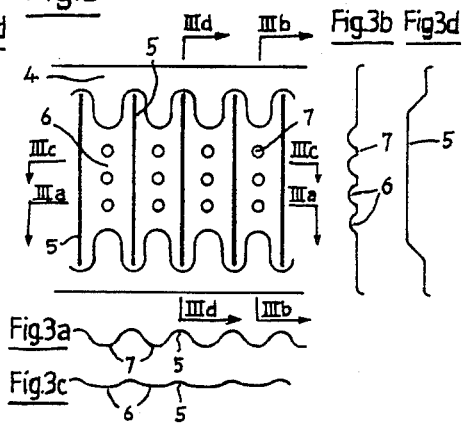
FIG. 3 is a front view of a development of a container or can body of a further embodiment of inventive can analogous to the showing of FIG. 2.
Figure 4:
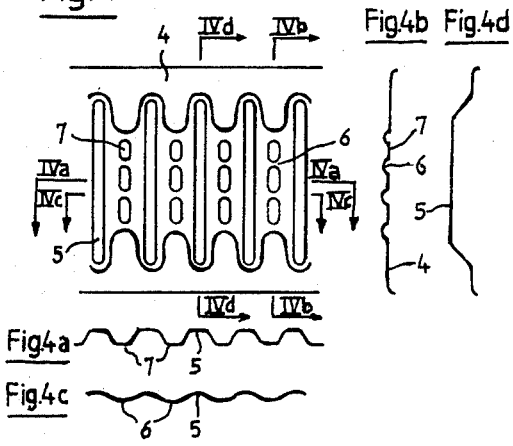
FIG. 4 is a front view of a can or container body shown in a development view in a plane analogous to the showing of FIG. 2 and depicting a further embodiment of inventive can.

Describing now the drawings, the can or container construction depicted in FIG. 1, and also in greater detail in FIGS. 2 to 4, has a substantially circular floor or base 1 and a cover or closure member 2 formed of metal plate or sheet metal and which, in conventional manner, are mounted upon a substantially cylindrical can body 4 likewise composed of metal plate or sheet metal and secured thereat, so that there is formed a sheet metal can 3. At the can body 4, which is intended to take-up the radially inwardly or outwardly effective forces Fr, especially during and/or following the cooking process when the cans are filled, for instance, with foodstuffs or the like, and also the axially effective force $F_a$ during the storage of the cans, there are provided axial beads 5, defining primary beads, extending essentially parallel to the lengthwise axis of the cylindrical can 3 and circumferential beads or crimps 6 or the like, defining auxiliary beads, extending essentially perpendicular to the axial beads 5.

At this point it is mentioned that the sheet metal can 3 also can possess a cross-sectional configuration which differs from the circular cylindrical cross-sectional shape. The can body 4 can be fabricated by welding,, soldering, deep drawing or stretching, by way of example. During deep drawing and stretching the can floor 1 and the can body 4 are formed of one-piece.

With the construction of the can body 4, according to the embodiments of FIGS. 2, 3 and 4, the axial beads 5 comprise an embossment or the like extending essentially over the entire height of the can body 4, see FIGS. 2*d*, 3*d*, 4*d*, these bead-forming embossments having a depth in the order of magnitude of 1 millimeter in the case of a can 3 which can contain 1 liter contents. The embossments, viewed in sectional view perpendicular to the lengthwise axis of the can, as shown for instance for the can embodiments of FIGS. 2*a* and 3*a*, can possess an arcuate-shaped or curved course, or else can possess for instance, a trapazoidal-shaped course or configuration having a flat base, as shown, for example for the embodiment of FIG. 4*a*.

Between the primary beads 5 there are located point-like protuberances 7 possessing an axial spacing from one another. These point-like protuberances or raised portions 7 may possess, as shown for the embodiment of FIGS. 2, 2*a* and 2*b*, a sector of a substantially spherical-shaped surface, or, as shown for the embodiment of FIGS. 3, 3*a* and 3*b*, a truncated cone-shaped surface, or, as shown for the embodiment of FIGS. 4, 4*a* and 4*b*, a pyramid-like surface. The protuberances or raised portions 7 do not have any effect upon the course of the base of the axial beads 5. Nonetheless, by virtue of the axially extending rows of protuberances 7 there is formed in each case a depression or furrow 6 between two protuberances 7 defining an auxiliary bead. Each depression or furrow 6 possesses in axial direction, as shown for the arrangement of FIG. 2*b*, a concave curved configuration or course, or an approximately semicircular-shaped configuration or course shown for the embodiments of FIGS. 3*b* and 4*b*, and in the circumferential direction a slightly convex curved configuration or course, as shown for the embodiments of FIGS. 2*c* and 3*c*, or an approximately linear configuration or course, as shown for the embodiment of FIG. 4*c*. The apex of the protuberances 7 advantageously is located in the plane of the originally unbeaded can body 4.

Figure 5:
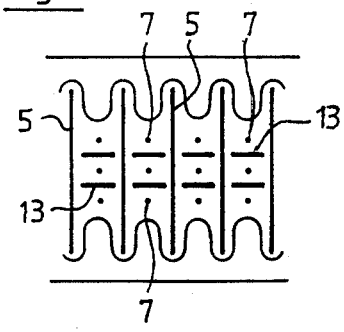
FIG. 5 is a view analogous to the showing of FIG. 2 of a further advantageous constructional embodiment of can.

With the variant construction of can as shown in FIG. 5 there can be provided in the same embossing direction as the axial beads 5, in each case between the protuberances 7 and two neighbouring beads 5, the beads 13 which extend essentially in the circumferential or peripheral direction. These beads 13 are of lesser depth than the beads 5. Their cross-section can be curved or trapazoidal in shape, just as was the case for the beads 5.

Therefore, there occurs only a slight material elongation during the fabrication of the beads which amounts to the value h indicated for the can construction of FIG. 2*b*, and the rated diameter of the can 3 need not be designed in consideration of a subsequent beading operation other than for a use without beading. The mean depth of the depressions or furrows 6 (FIGS. 1 to 5) and 16 (FIGS. 6 to 11) is dependent upon the mutual spacing of the protuberances or raised portions 7 (FIGS. 1 to 5) and 17 (FIGS. 6 to 11) and upon their elongation and can be chosen in accordance with the requirements placed upon the cans 3.

The additional beads 13 (FIG. 5) can also be provided without the protuberances or raised portions 7 according to the showing of FIGS. 3 and 4.

In the exemplary embodiments of can constructions depicted in FIGS. 1 to 5 the axially extending beads, constituting the primary beads, are dominant. Accordingly, there are afforded appreciably increased strength values in the axial direction.

If, on the other hand, there are required appreciably higher strength values in the radial direction, then there are preferably constructed to be dominant the circumferential or peripheral beads. Such has been illustrated, for instance, for the modified constructions of cans depicted in FIGS. 6 to 11 and as will be now described.

With the variant construction of can depicted in FIG. 6, and just as was the case for the can construction of FIG. 1, such sheet metal can 3 has been shown provided with a can floor or base portion 1, a cover or closure member 2, and the can body 4. Between the dominating primary beads or embossments 15, here shown extending over the circumference of the can body 4, see FIGS. 8*c*, 9*c*, 10*c*, there are located the protuberances or raised portions 17 defining therebetween the auxiliary beads. These protuberances or raised portions 17, for instance as shown for the can construction of FIGS. 7, 8*a* and 8*b*, can possess a spherical-shaped surface, or, as shown for the can construction of FIGS. 9, 9*a* and 9*b*, can possess a truncated cone-like surface, or, as shown for the can construction of FIGS. 10, 10*a* and 10*b*, can possess a pyramid-like surface. The protuberances or raised portions 17 do not have any effect upon the course or configuration of the bead base of the primary beads 15. Nonetheless, by virtue of the peripherally extending rows of protuberances or raised portions 17 there is formed in each case a depression or furrow 16 between two protuberances 17 defining a respective one of the auxiliary beads. Each depression or furrow 16, as heretofore mentioned defining an auxiliary bead, possesses in the circumferential direction, for instance as shown for the can construction of FIG. 8*a*, a concave curved configuration or course, or, as shown for the can constructions of FIGS. 9*a* and 10*a*, an approximately semicircular shaped course, and in the axial direction a slightly convex curved configuration or course, as shown for the can constructions of FIGS. 8*d* and 9*d*, or, as shown for the can construction of FIG. 10*d*, an approximately linear configuration or course. The apex of each of the protuberances 17 advantageously is located in the plane of the original unbeaded can jacket or shell.

Analogous to the depressions or furrows 6, which form the circumferential auxiliary beads for the can constructions of FIGS. 1 to 5, with the constructions of cans shown in FIGS. 6 to 11 there is formed by the depressions or furrows 16 axial auxiliary beads 16 which essentially extend over the entire height of the can body 4.

By virtue of the minimum beading of the can body 4 as well as the configuration of the beads 5 and 15 and the raised portions 7 and 17 the can 3 can be fabricated with lesser beading work. There is not present any appreciable danger of rejects due to elongation or deformation fissures.

Figure 12:
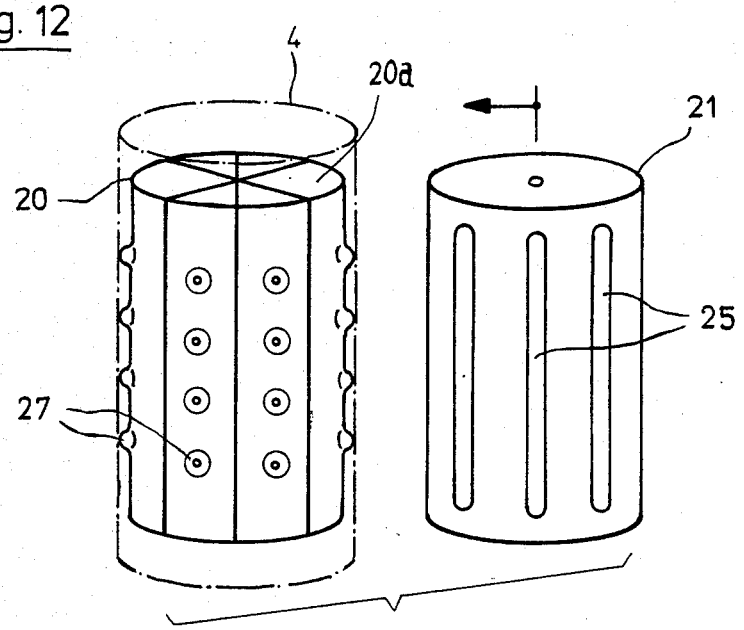
FIG. 12 is a perspective view of coacting beading tools for carrying out the beading operation performed at the can bodies according to FIGS. 1 to 5.
Figure 13:
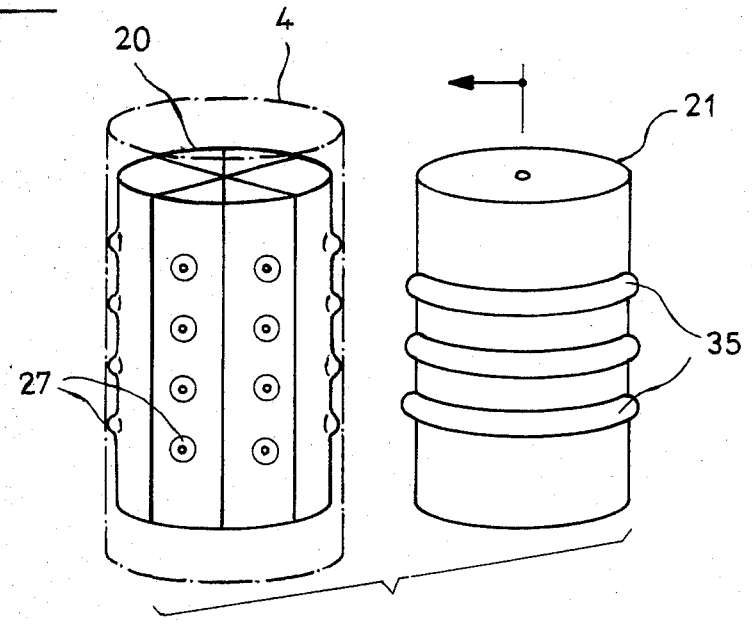
FIG. 13 is a perspective view of coacting beading tools for carrying out the beading operation performed at the can bodies according to FIGS. 6 to 11.

For the purpose of producing the above-described beads there can be advantageously used the tools shown in FIGS. 12 and 13.

Internally of the can body 4 there is provided, as best seen by referring to FIG. 12, an expandable tool 20 formed of the individual tool segments 20*a*. Upon the jacket or outer surface of the expandable tool 20 there are provided wart-like nipples or bulbous portions 27 which are in frictional contact with the inner surface of the can body 4 upon expansion of the expandable tool 20.

Arranged substantially axially parallel to the inner tool 20 and likewise rotatable is an outer tool 21 upon whose jacket or outer surface there are provided the bead-like protuberances or protruding beading elements 25.

In the work position the bead-like protuberances 25 engage in each case between two adjacently situated nipples or projections 27 and form the inwardly directed axial primary beads 5. Between each two respective superimposed nipple rows there are simultaneously formed the circumferential auxiliary beads 6.

FIG. 13 analogously shows the coacting beading tools 20 and 21 for forming the beading or beads for the can constructions depicted in FIGS. 6 to 11.

In this case the inner tool 20 is likewise equipped with nipples or projections 27. The outer tool 21 possesses, in this exemplary embodiment, circular bead-like projections or beading elements 35 which in the work position engage between the superimposed nipples or projections 27 and form the concave primary beads 15.

Between each two adjacently situated nipples or projections 27 there is simultaneously formed the vertical auxiliary bead 16 which possesses the same embossment direction as the beads 15.

For producing the elongate raised portions or protuberances 7, 13 and 17 according to FIGS. 4, 5 as well as FIGS. 10, 11 there must of course be provided appropriate bead-like nipples or beads.

While there are shown and described present preferred embodiments of the invention, it is to be distinctly understood that the invention is not limited thereto, but may be otherwise variously embodied and practiced within the scope of the following claims. Accordingly,

What we claim is:

1. A can body formed of a thin-walled metallic material, comprising:

said can body being provided with beads extending essentially in axial direction and in circumferential direction for the purpose of increasing the strength of the can body;

said beads comprising primary beads extending in a first predetermined direction and auxiliary beads extending in a second predetermined direction essentially at right angles to said primary beads;

said primary beads being continuous in said first predetermined direction with a substantially constant depth in the same radial direction and being arranged in a spaced relationship with respect to said second predetermined direction;

a plurality of protuberances;

said plurality of protuberances extending all in the same radial direction in the opposite radial direction of said primary beads;

said plurality of protuberances defining rows of protuberances with each said row extending in said first predetermined direction along with said primary beads between two adjacent primary beads;

each said auxiliary bead which extends in said second predetermined direction being located between two adjacent protuberances of a related row of protuberances; and said auxiliary beads extend in one of the two radial directions and to a lesser depth than said primary beads.

2. The can body as defined in claim 1, wherein:

said protuberances possess a substantially spherical-shaped surface.

3. The can body as defined in claim 1, wherein:

said protuberances possess a substantially truncated cone-shaped surface.

4. The can body as defined in claim 1, wherein:

said protuberances possess a substantially truncated pyramid-shaped surface.

5. The can body as defined in claim 1, wherein:

the depth of the primary beads amounts to 1.2-fold to 3-fold the depth of the auxiliary beads.

6. The can body as defined in claim 1, wherein:

said primary beads possess a substantially arcuate-shaped cross-sectional configuration.

7. The can body as defined in claim 1, wherein:

said primary beads possess a substantially trapazoidal-shaped cross-sectional configuration.

* * * * *

UNITED STATES PATENT AND TRADEMARK OFFICE

CERTIFICATE OF CORRECTION

PATENT NO. : 4,512,490

DATED : April 23, 1985

INVENTOR(S) : SIEGFRIED FREI et al

It is certified that error appears in the above—identified patent and that said Letters Patent is hereby corrected as shown below:

On the title page;

In the Abstract, line 5 please delete "these" and insert —there—

Column 3, line 13 please delete "blan-" and insert —blank—

Column 3, line 14 please delete "k"

Signed and Sealed this

*First* Day of *October 1985*

[SEAL]

*Attest:*

DONALD J. QUIGG

*Attesting Officer*

*Commissioner of Patents and Trademarks—Designate*